US005966797A

United States Patent [19]

Okazaki et al.

[11] Patent Number: 5,966,797

[45] Date of Patent: Oct. 19, 1999

[54] METHOD OF MANUFACTURING A DAMPER FOR A LOUDSPEAKER

[75] Inventors: Masatoshi Okazaki, Ashiya; Shinya Mizone, Tsu; Toshihiro Shimizu, Matsusaka; Toshihide Tomikawa, Osaka; Toyohiro Tanaka, Sakai, all of Japan

[73] Assignee: Matsushita Electric Industrial Co., Ltd., Kadoma, Japan

[21] Appl. No.: 09/208,138

[22] Filed: Dec. 9, 1998

Related U.S. Application Data

[62] Division of application No. 08/411,433, Mar. 27, 1995, Pat. No. 5,878,150.

[30] Foreign Application Priority Data

Mar. 28, 1994 [JP] Japan ..... 6-57343

[51] Int. Cl.[6] ..... D21J 3/12

[52] U.S. Cl. ..... 29/527.2; 29/527.1

[58] Field of Search ..... 29/527.2, 527.1; 181/166, 169; 264/324; 381/396, 403–405, 413, 426, 428

[56] References Cited

U.S. PATENT DOCUMENTS

| | | |
|---|---|---|
| 3,596,733 | 8/1971 | Bertagni . |
| 4,122,314 | 10/1978 | Matsuda et al. . |
| 4,198,550 | 4/1980 | Matsuda et al. . |
| 4,239,944 | 12/1980 | Obara et al. . |
| 4,291,205 | 9/1981 | Kamon et al. . |
| 4,623,586 | 11/1986 | Umeya et al. . |
| 4,968,551 | 11/1990 | Kusanagi et al. . |
| 5,004,764 | 4/1991 | Yamamoto et al. . |
| 5,031,720 | 7/1991 | Ohta et al. . |
| 5,191,697 | 3/1993 | Sakamoto et al. . |
| 5,283,027 | 2/1994 | Sakamoto et al. . |
| 5,550,332 | 8/1996 | Sakamoto . |
| 5,619,019 | 4/1997 | Yoshimura . |

FOREIGN PATENT DOCUMENTS

| | | |
|---|---|---|
| 0439960 | 8/1991 | European Pat. Off. . |
| 0508596 | 10/1992 | European Pat. Off. . |
| 6038296 | 2/1994 | Japan . |

OTHER PUBLICATIONS

European Search Report related to European Patent Application No. 95104511.1 mailed Jul. 13, 1995.

*Primary Examiner*—P. W. Echols
*Attorney, Agent, or Firm*—Renner, Otto, Boisselle & Sklar, P.L.L.

[57] ABSTRACT

A damper for a loud speaker is produced by molding a substrate into a desired shape in which a fabric or knitted cloth composed of core-sheath type conjugate fibers composed of filaments having a core-sheath type structure is used as the substrate. A resin used for forming a core material in the core-sheath type structure functions as a matrix of the substrate. A sheath material having a lower melting point than that of the core material functions as an excipient, and is fused by a heat treatment and then solidified during the molding process, so as to bond together the intersections of fibers constituting the substrate and to cover the surface of the fibers. Thus, only a simple substrate production process is required and a damper for a loud speaker having excellent moldability, water-proofness, and durability is obtained.

12 Claims, 6 Drawing Sheets

METHOD OF MANUFACTURING A DAMPER FOR A LOUDSPEAKER

This is a division of copending application Ser. No. 08/411,433, filed Mar. 27, 1995, now U.S. Pat. No. 5,878, 150.

BACKGROUND OF THE INVENTION

1. Field of the Invention

The present invention relates to a damper for use in a loud speaker to be used for various acoustic apparatuses, and a method for producing the same.

2. Description of the Related Art

FIG. 1 is a half cross-sectional view showing a configuration for a typical loud speaker 20. FIG. 2 is an exploded perspective view showing details of the loud speaker 20. The same constituent elements are indicated by the same reference numerals in FIGS. 1 and 2.

As shown in FIGS. 1 and 2, the loud speaker 20 includes a lower plate 3 integral with a center pole 2, a magnet ring 4 provided on a bottom portion of the lower plate 3 so as to surround the center pole 2, and an upper plate 5 provided on an upper face of the magnet ring 4. The lower plate 3, the magnet ring 4, and the upper plate 5 are coupled to one another to constitute a magnet circuit 1.

On an upper face of the upper plate 5, an inner periphery of the frame 6 is coupled. A gasket 7 and an outer periphery of a diaphragm 8 are attached to an outer periphery of the frame 6 by using an adhesive. A voice coil 9 is coupled to an inner periphery of the diaphragm 8.

A middle portion of the voice coil 9 is supported by an inner periphery of the damper 10, an outer periphery of the damper 10 being supported by the frame 6. A lower portion of the voice coil 9 is inserted into a magnetic gap 11 formed between the center pole 2 of the lower frame 3 and the upper frame 5 (which are included in the magnetic circuit 1) without being eccentric. Moreover, a dust cap 12 for preventing dust from entering the magnetic circuit 1 is provided on the upper side of a central portion of the diaphragm 8.

The damper 10 functions as a support for the voice coil 9. That is, the damper 10 functions to prevent the voice coil 9 from making unfavorable movements, e.g., excessive vibration or rolling, even when an excessive vibration is applied to the voice coil 9.

The damper 10 is conventionally produced by forming a prepreg, which serves as a substrate, into a predetermined shape by using a heated mold. The prepreg is formed by impregnating a fabric matrix composed of cotton yarn, aramid fiber yarn, phenol fiber yarn, or a blended yarn thereof with a thermosetting resin such as phenol resin or melamine resin as an excipient.

However, the conventional damper produced in the above-mentioned manner, or the producing method itself, has the four following problems.

First, the efficiency of the production method is not optimized. In the above-described conventional method for producing a damper, a step for forming a prepreg by impregnating a fabric with an excipient is required. Solutions such as phenol resin and melamine resin, which are used as excipients in this step, may act on the skin of a person engaged in the production thereof to cause a rash or may generate poisonous gases when dried, thereby hindering work efficiency.

Second, deformation of the damper during the production process may occur. In the above-mentioned production method, the excipient included in the prepreg is a thermosetting resin, which is to be cured by a thermal reaction in a mold heated at a predetermined temperature into a predetermined shape. On the other hand, the fabric included in the prepreg is composed of natural fibers such as cotton yarn, or heat-resistant artificial fibers such as aramid fibers or phenol fibers, and therefore is hardly deformed during the heating process using the heated mold. In other words, the shape of the damper is conserved by the excipient. However, the damper is liable to deform during the production process for the following reasons. In order to reduce the time required for molding, the mold is usually heated at a relatively high temperature, e.g., 180° C. or more. As a result, the damper set in the mold cannot be sufficiently cooled after the curing reaction terminates, so that it is still in a relatively soft, rubber-sheet like state. When one attempts to remove the molded damper in this state from the mold, the damper may not retain the predetermined shape due to the internal stress of the fabric having relatively high stiffness, and consequently is often deformed.

Third, the durability of the damper as a constituent element of a loud speaker may be inadequate. The function of a molded damper results in it being repeatedly deformed through flexure and bending. Since the phenol resin, melamine resin, and the like used as excipient materials have relatively low comformability with the fibers constituting the fabric, peeling may occur at interfaces between the fabric and the excipient through use over time. Moreover, although the excipient (such as phenol resin or melamine resin), which coats over the surface of the fibers of the fabric in the form of a relatively thin film, maintains a very high elasticity when cooled to room temperature after the molding, it has a low internal loss and, consequently, relatively high fragility. As a result, the thin film of excipient may not withstand the flexure of the fabric having high flexibility and accordingly be ripped. In that case, the bonds at the intersections of the fibers of the fabric are destroyed, greatly reducing the stiffness of the entire damper.

Fourth, the water-proofness of the damper may be inadequate. Dampers to be used for loud speakers attached on the doors of automobiles are required to have little deformation against repetitive moistening and drying. However, the above-mentioned resin materials constituting the excipient have relatively high water absorption rates, and the excipient itself is likely to be deformed.

Furthermore, as mentioned in the third problem above, if a crack is created on the surface of the excipient covering the fibers of the fabric, moisture may enter through the crack. As a result, the fibers of the fabric may absorb moisture so as to be stretched, causing the molded damper to be deformed, whereby the properties of the loud speaker are unfavorably affected.

SUMMARY OF THE INVENTION

The damper for a loud speaker of the invention is formed using as a substrate a fabric or knitted cloth composed of conjugate fibers, each of the conjugate fibers being formed using at least one filament having a core-sheath type structure, wherein the core-sheath type structure includes: a core material formed of a first resin; and a sheath material formed of a second resin and functioning as a thermal fusion layer.

In one embodiment, the substrate is molded into a desired shape by a pressing process involving a heat treatment.

In another embodiment, a difference in softening points of the first and second resins is 15° C. or more. Preferably, a difference in softening points of the first and second resins is 30° C. or more.

In still another embodiment, the first resin is polyester, and the second resin is polyester having a lower melting point than that of the first resin.

In still another embodiment, the first resin is polyester having a melting point of 220° C. or more, and the second resin is polyester having a melting point of 200° C. or less.

According to another aspect of the invention, the method for producing a damper for a loud speaker, the damper being formed using as a substrate a fabric or knitted cloth composed of conjugate fibers, each of the conjugate fibers being formed using at least one filament having a core-sheath type structure, the core-sheath type structure including a core material formed of a first resin and a sheath material formed of a second resin functioning as a thermal fusion layer, includes: a pressing step for molding the substrate by applying a predetermined pressure for a first predetermined period using a mold which is set at a first predetermined temperature; and a trimming step for trimming the molded substrate into a predetermined shape.

In one embodiment, a difference in softening points of the first and second resins is 15° C. or more. Preferably, a difference in softening points of the first and second resins is 30° C. or more.

In another embodiment, the first resin is polyester, and the second resin is polyester having a lower melting point than that of the first resin.

In still another embodiment, the first resin is polyester having a melting point of 220° C. or more, and the second resin is polyester having a melting point of 200° C. or less.

In still another embodiment, the pressing step further includes: a clamping step for clamping the substrate while applying a predetermined tension; and a preheating step for placing the clamped substrate in an atmosphere at a second predetermined temperature which is in the vicinity or higher than the softening point of the second resin for a second predetermined period, wherein the first predetermined temperature in the pressing step is equal to or lower than a solidification point of the second resin.

In still another embodiment, the first predetermined temperature in the pressing step is a temperature in the vicinity of or higher than the softening point of the second resin.

In still another embodiment, the pressing step further includes a cooling step for cooling the molded substrate to a third predetermined temperature which is equal to or lower than a solidification point of the second resin while being maintained in the mold, and the first predetermined temperature in the pressing step is a temperature in the vicinity of or higher than the softening point of the second resin.

A loud speaker of the invention includes: a magnetic circuit portion including a magnetic gap; a frame coupled to an upper face of the magnetic circuit portion; a diaphragm, an outer periphery thereof being attached to an outer periphery of the frame; a voice coil coupled to an inner periphery of the diaphragm and inserted into the magnetic gap; and a damper supporting a center portion of the voice coil, wherein the damper is formed using as a substrate a fabric or knitted cloth composed of conjugate fibers, each of the conjugate fibers being formed using at least one filament having a core-sheath type structure, the core-sheath type structure including a core material formed of a first resin and a sheath material formed of a second resin functioning as a thermal fusion layer.

According to another aspect of the invention, the method for producing a loud speaker including a damper, the damper being formed using as a substrate a fabric or knitted cloth composed of conjugate fibers, each of the conjugate fibers being formed using at least one filament having a core-sheath type structure, the core-sheath type structure including a core material formed of a first resin and a sheath material formed of a second resin functioning as a thermal fusion layer, includes: a pressing step for molding the substrate by applying a predetermined pressure for a first predetermined period using a mold which is set at a first predetermined temperature; and a trimming step for trimming the molded substrate into a predetermined shape.

In one embodiment, the pressing step further includes: a clamping step for clamping the substrate while applying a predetermined tension; and a pre-heating step for placing the clamped substrate in an atmosphere at a second predetermined temperature which is in the vicinity or higher than the softening point of the second resin for a second predetermined period, wherein the first predetermined temperature in the pressing step is equal to or lower than a solidification point of the second resin.

In another embodiment, the first predetermined temperature in the pressing step is a temperature in the vicinity of or higher than the softening point of the second resin.

In still another embodiment, the pressing step further includes a cooling step for cooling the molded substrate to a third predetermined temperature which is equal to or lower than a solidification point of the second resin while being maintained in the mold, and the first predetermined temperature in the pressing step is a temperature in the vicinity of or higher than the softening point of the second resin.

Thus, the invention described herein makes possible the advantages of (1) providing a damper for a loud speaker, the damper requiring no process for producing a prepreg during the production thereof; (2) providing a damper for a loud speaker, the damper not being liable to deformation during the molding thereof; (3) providing a high-performance damper for a loud speaker, the damper having little deterioration in the performance thereof during use, excellent water-proofness, and excellent durability; (4) providing a loud speaker incorporating such a damper; and (5) providing a method for producing the damper for a loud speaker and a method for producing a loud speaker incorporating the damper.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of examples, with reference to the accompanying drawings.

The damper for a loud speaker according to the present invention is produced by molding a substrate composed of a fabric including bicomponent fibers having a core-sheath structure (i.e., so-called core-sheath type conjugated fibers) into a predetermined shape.

Figure 1:
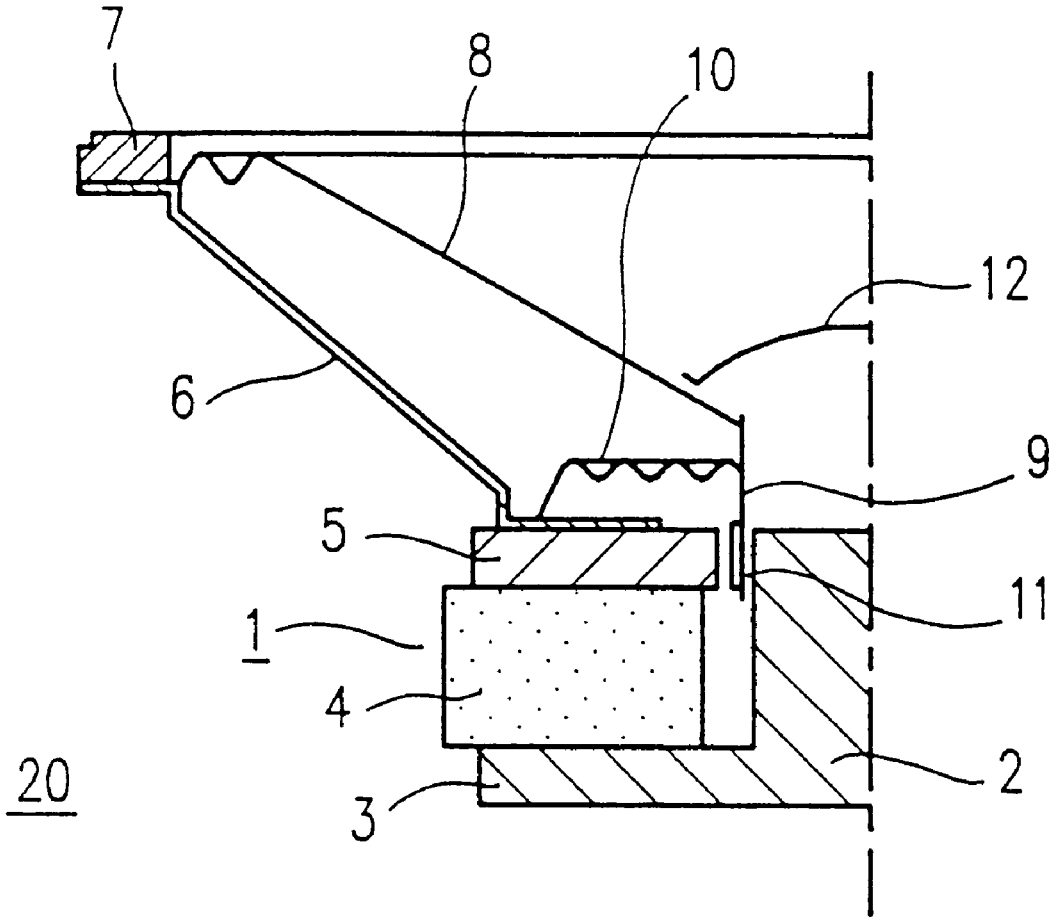
FIG. 1 is a half cross-sectional view showing a configuration for a typical loud speaker.
Figure 2:
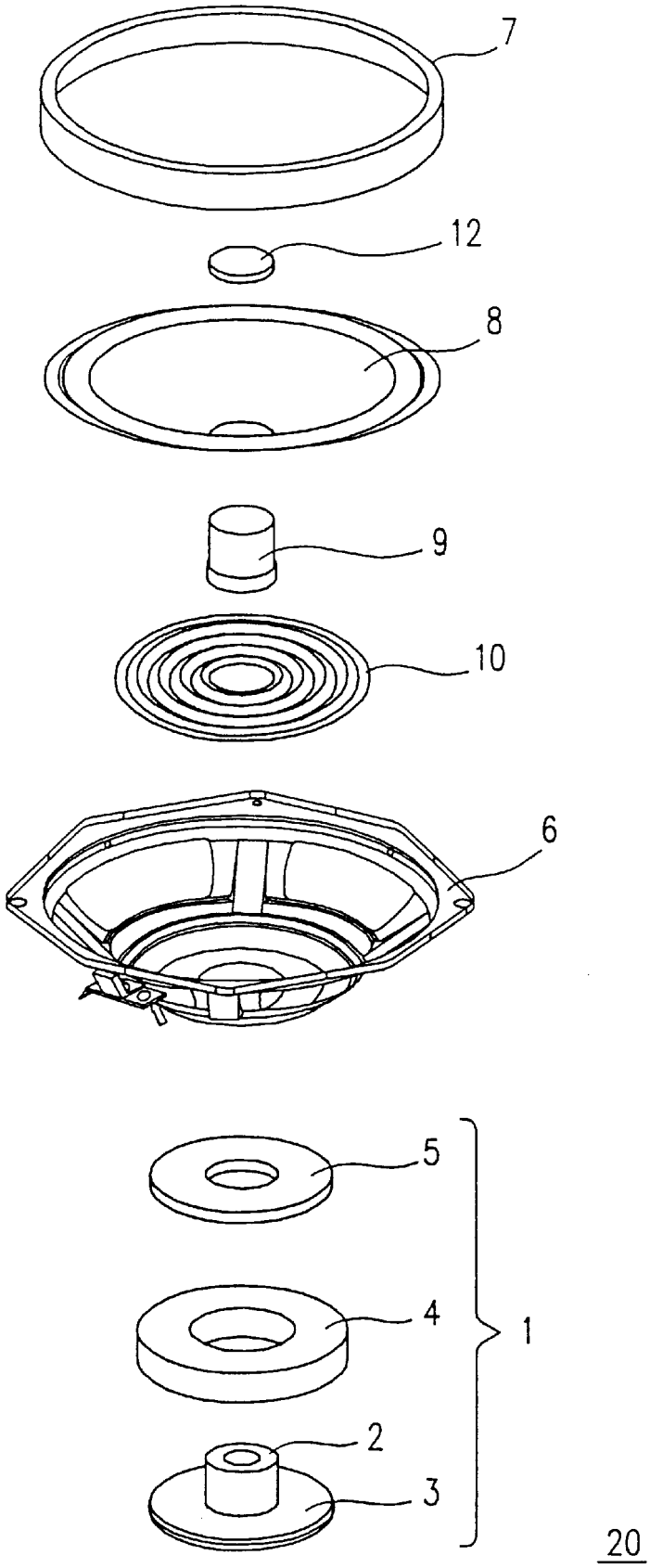
FIG. 2 is an exploded perspective view showing details of the loud speaker shown in FIG. 1.
Figure 3:
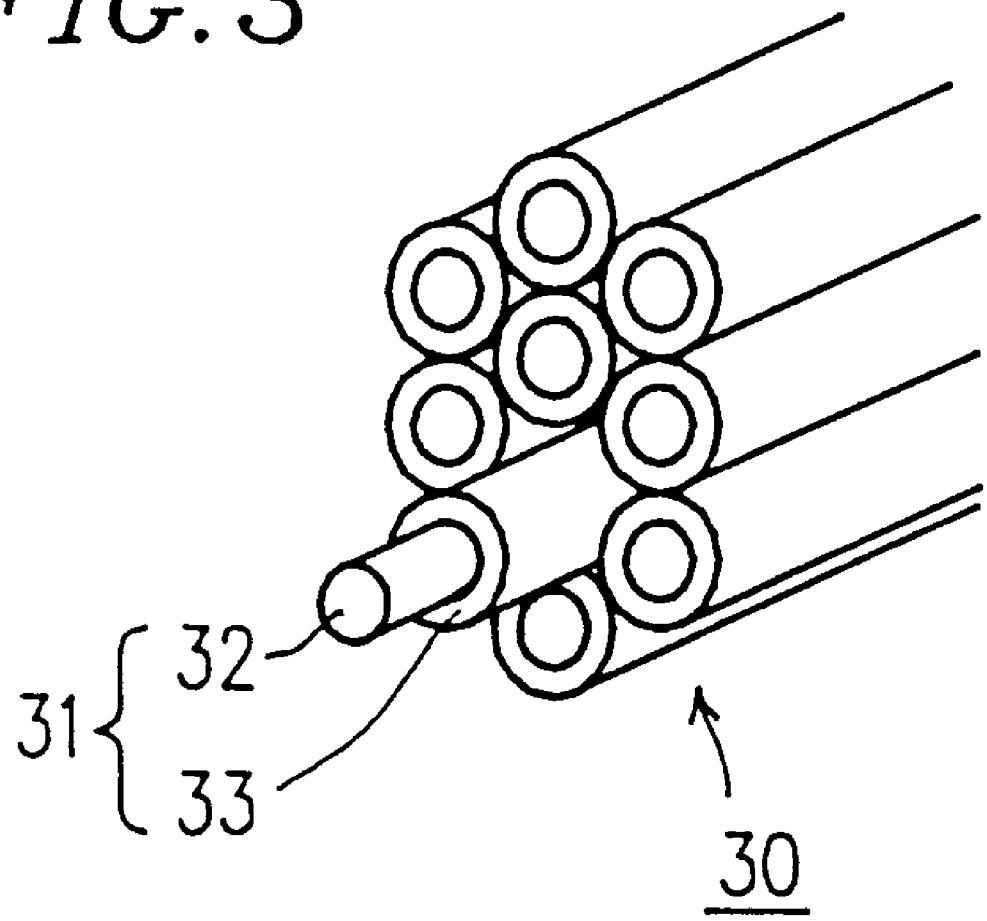
FIG. 3 is a view showing filaments constituting core-sheath type conjugated fibers used for the damper for a loud speaker according to the present invention, the filaments having a core-sheath structure.

FIG. 3 schematically shows a core-sheath type conjugated fiber used for the damper for a loud speaker according to the present invention. As shown in FIG. 3, each core-sheath type conjugated fiber 30 is composed of a plurality of filaments 31 twisted together. Each filament 31 has a core-sheath structure in which the surface of a core material 32 composed of a physically strong resin is coated with a sheath material 33 composed of a resin having a lower melting point than that of the core material 32 and functioning as a heat fusion layer. A fabric obtained by weaving the core-sheath conjugated fibers 30 into a mesh structure is molded into a desired damper shape by a pressing process involving a heating treatment (to be described later).

Figure 4A:
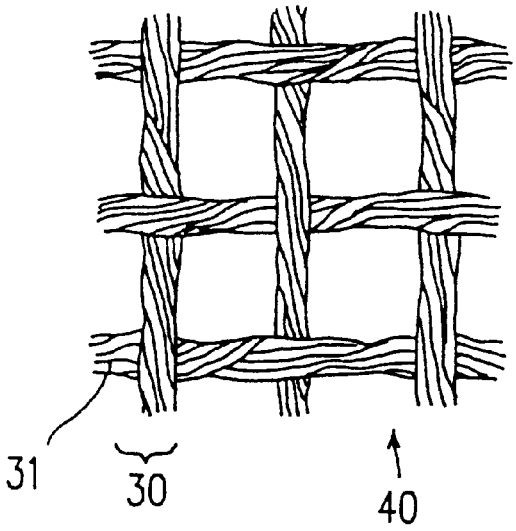
FIGS. 4A and 4B are views showing the surface states of filaments of a fabric before and after the molding, respectively.
Figure 4B:
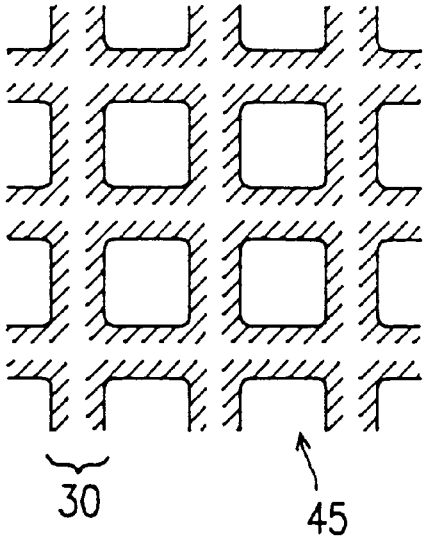

FIG. 4A schematically shows an unmolded fabric 40, while FIG. 4B schematically shows a molded fabric 45. In the unmolded fabric 40 (FIG. 4A), each filament 31 constituting the core-sheath conjugated fibers 30 can be easily recognized. On the other hand, in a molded fabric 45 (FIG. 4B), the low-melting point resin of the sheath material 33 (FIG. 3) is melted by a heat treatment during the molding process and then solidified so as to cover the entire surface of the core-sheath conjugated fibers 30. Moreover, intersections of warp yarns and weft yarns are thermally fused with the resin of the sheath material 33, which has melted and then solidified, so as to be bonded together.

Examples of high-melting point and physically strong resins (hereinafter referred to as the "first component") to be used for the inner core material of the filaments of the core-sheath structure include: fiber-forming thermoplastic resins such as polypropylene, polyester, and nylon-66. Among these resins, polyamide or polyester fibers, and particularly polyester fiber components with an ordinary-to-high viscosity having an intrinsic viscosity (n) of about 0.6 to 1.2 poise are particularly preferably employed.

Specifically, polyester resins prepared by mixing aromatic dicarboxylic acids, e.g., phthalic acid, isophthalic acid, and naphthalene dicarboxylic acid, and aliphatic or alicyclic diols, e.g., ethylene glycol, propylene glycol, and p-xylene glycol, in predetermined amounts and carrying out a condensation reaction can be used. Particularly preferable is polyethylene terephthalate (PET) or the like.

Examples of low-melting point resins (hereinafter referred to as the "second component") to be used for the outer sheath material of the filaments of the core-sheath structure include: thermoplastic resins having melting points lower by 15° C. or more, and preferably 30° C. or more, than that of the thermoplastic resin used for the first component (the core material), such as low density polyethylene, high density polyethylene, ethylene-vinyl acetate copolymer, ethylene-propylene copolymer, low melting point polyester, polyamide resins such as nylon-6, etc. or mixtures of these.

Among the thermoplastic resins with low melting points to be used as the second component, polyesters with low melting points are preferable. Particularly preferably are: copolymerized polyesters resins prepared by mixing aliphatic dicarboxylic acids, e.g., adipic acid and sebacic acid, aromatic dicarboxylic acids, e.g., phthalic acid, isophthalic acid, and naphthalenedicarboxylic acid, and/or alicyclic dicarboxylic acids, e.g., hexahydroterephthalic acid, and aliphatic or alicyclic diols, e.g., ethylene glycol, diethylene glycol, polyethylene glycol, propylene glycol, hexane diol, and p-xylene glycol, in predetermined amounts, adding, if necessary, an oxyacid, e.g., p-xylene-benzoic acid and p-hydroxybenzoic acid, and carrying out a condensation reaction.

Particularly, a polyester, etc., obtained by adding isophthalic acid and 1,6-hexane diol to terephthalic acid and ethylene glycol and carrying out a copolymerization is preferable.

These first and second components are spun by a known composite spinning method into a core-sheath structure where the first component serves as the core material, whereby filaments are obtained. It is preferable that the second component constituting the sheath material accounts for 16% to 50%, and preferably 25% to 40%, of the entire cross-sectional area of the resultant filament.

By including the second component in the filament at the above-mentioned area ratio, the intersections of warp yarns and weft yarns of the mesh-like fabric are thermally fused with good security during the fusion and solidification of the second component resin occuring in the heat treatment to be performed with the molding.

The thickness of each filament having the above-mentioned core-sheath structure should be 1 denier or more, and preferably 5 to 200 deniers. Filaments having a thickness of 20 to 100 deniers are particularly preferable.

In FIGS. 3 and 4A, the above-described filaments are employed as multi-filaments, that is, a plurality of filaments are twisted together to form the core-sheath type conjugate fibers. However, the filaments may also be used as a mono-filament.

Hereinafter, an example of the present invention will be described. In the example, core-sheath structured filaments (thickness: 75 deniers) are employed, each filament including a core material of a polyester fiber (melting point: 230° C.) with a sheath material of modified polyester (melting point: 180° C.) conjugated on the surface thereof. Core-sheath type conjugated fibers consisting of 24 such filaments are plain weaved into a fabric consisting of 50 warp yarns/inch and 50 weft yarns/inch, the fabric being used as a substrate for the damper. An example of such a fabric is one obtained by weaving "Bellcouple" TGG50L-75d ("Bellcouple" TGG50L-75d is the general trade designation for a thermal fusion polyester filament manufactured by Kanebo, Ltd.). The fabric is molded by a pressing process involving a heat treatment, and is subjected to a trimming process so as to have predetermined inner and outer shapes. Thus, a damper for a loud speaker according to the present invention is obtained.

The following three methods are applicable to the pressing process, according to the present invention.

(1st pressing method)

Figure 5A:
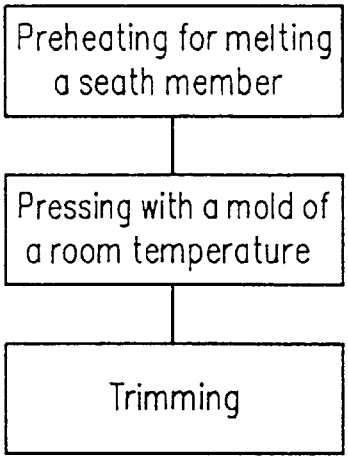
FIGS. 5A to 5C are flow charts showing the molding process for a damper for a loud speaker according to the present invention.

FIG. 5A shows a flow chart of a first pressing method. The method employs a disk clamp having a center hole with an inner diameter sufficiently large with respect to an outer diameter of the damper to be formed. The disk clamp is used for clamping the above-mentioned fabric (substrate) from above and below, so as to stabilize the fabric at a certain tension. The tension of the fabric should be such a value that the substrate is prevented from having waving, creases, etc. because of shrinkage during the heat treatment, and is determined in accordance with the shrinkage rate, etc., which in turn depends on the weave or knit structure of the substrate and the yarns to be used. Typically, the tension is prescribed to be 0.01 to 1 kg/cm, e.g., 0.05 kg/cm. The fabric maintained in this state is placed, in a pre-heating step, in an atmosphere at a temperature in the vicinity or higher of the melting point of the resin (first component) forming the sheath material, so as to sufficiently fuse the resin forming the sheath material. Specifically, the fabric is left in an atmosphere at a temperature in the range of 180° C. to 220° C. for 10 to 30 seconds. For example, the fabric may be left in an atmosphere at 200° C. for 20 seconds. Thereafter, the fabric, whose sheath material has fused, is set in a mold maintained at a temperature equal to or lower, e.g., room temperature, than the solidification point of the resin forming the sheath. Then, a pressure of 0.5 to 5 kg/cm$^2$ is applied to the fabric for 1 to 10 seconds. For example, a pressure of 2 kg/cm$^2$ may be applied to the fabric for 5 seconds. Then, the mold is opened so as to remove the fabric which has been molded. The fabric is subjected to a trimming process to form a damper for a loud speaker.

(2nd pressing method)

Figure 5B:
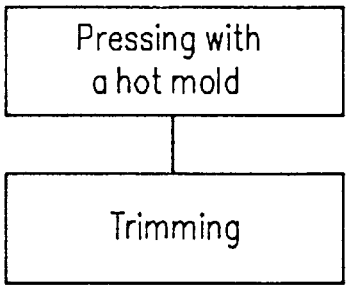

FIG. 5B shows a flow chart of a second pressing method. According to this method, the fabric (substrate) is set in a mold maintained at a temperature in the vicinity of or higher than the melting point of the resin forming the sheath material. For example, the fabric may be set in a mold maintained at a temperature in the range of 160° C. to 200° C., e.g., 180° C., preferably. Then, a pressure of 0.5 to 5 kg/cm$^2$ is applied to the fabric for 5 to 20 seconds. For example, a pressure of 2 kg/cm$^2$ may be applied to the fabric for 10 seconds. Then, the mold is opened so as to remove the fabric which has been molded. The fabric is subjected to a trimming process to form a damper for a loud speaker.

(3rd pressing method)

Figure 5C:
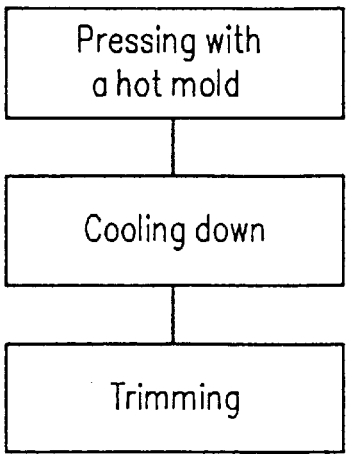

FIG. 5C shows a flow chart of a third pressing method. According to this method, the fabric (substrate) is set in a mold maintained at a temperature in the vicinity of or higher than the melting point of the resin forming the sheath material. For example, the fabric may be set in a mold maintained at a temperature in the range of 160° C. to 200° C., e.g., 180° C., preferably. Then, a pressure of 0.5 to 5 kg/cm$^2$, e.g., 2 kg/cm$^2$, is applied to the fabric. Thereafter, the fabric is cooled to a temperature equal to or lower than the solidification point of the resin forming the sheath material, e.g., 70° C., while being maintained in the mold and under the same pressure. Then, the mold is opened so as to remove the fabric which has been molded. The fabric is subjected to a trimming process to form a damper for a loud speaker.

The dampers for a loud speaker obtained by the first to third pressing methods mentioned above have substantially the same appearance and characteristics such as softness.

According to the first pressing method, the sheath material of the filaments is sufficiently fused in the pre-heating step, so that the sheath material can fully function as an excipent.

According to the second pressing method, some care is required so as not to deform the molded fabric when removing it from the mold because the fabric is still soft. However, in the case where a relatively thick fabric is used, the risk of deformation is substantially reduced, so that the use of the second pressing method can be effective. In particular, the second pressing method is the most simplified of the three methods in that the pre-heating step in the first method and the cooling step in the third method are omitted. As a result, the overall processing time can be reduced and working efficiency can be improved.

On the other hand, the third pressing method has an advantage in that the fabric is not likely to be deformed because it is removed out of the mold after being cooled following the pressing process.

Thus, each of the first to third methods has an advantage. Therefore, either one of the three methods can be selected depending on the characteristics of the core resin and the sheath resin and the various requirements of the production process (for example, the production process may strongly need to be shortened).

Table 1 shows typical values of dimension accuracy and water-proofness (water absorption rate and dimension stability) of the respective dampers for a loud speaker produced by the above-mentioned first to third methods. For comparison, Table 1 also shows the measurements of the above values of a conventional damper. The conventional damper is obtained by: using as a substrate a fabric including a plain-weaved cotton fabric consisting of #100 cotton yarns (100 warp yarns/inch and 100 weft yarns/inch) impregnated with 5% by weight of phenol resin, and applying a pressure of 2 kg/cm$^2$ to the fabric in a mold maintained at 220° C. for 5 seconds.

TABLE 1

| | | | water proofness | |
|---|---|---|---|---|
| | | dimension accuracy (mm) | water absorption rate (%) | dimension stability (mm) |
| Present invention | 1st method | 0.14 | 12.8 | 0.15 |
| | 2nd method | 0.22 | 13.1 | 0.23 |
| | 3rd method | 0.11 | 12.3 | 0.12 |
| Conventional | | 0.85 | 49.7 | 1.02 |

The dimension accuracy is indicated by the planarity of the outer periphery of the molded damper, the planarity being obtained by measuring a warp of the outer periphery of a bottom face of the damper by means of a height gauge while placing it on a surface plate. The water absorption rate is obtained by soaking the damper in boiled water for an hour, drying the damper at room temperature for 10 minutes so as to remove the moisture on the surface, and measuring the change rate in weight from the initial weight thereof. The dimension stability is obtained by soaking the damper in boiled water for an hour, drying the damper at room temperature for 10 minutes so as to remove the moisture on the surface, and measuring a warp of the outer periphery of a bottom face of the damper by means of a height gauge while placing it on a surface plate.

As seen from Table 1, the damper of the present invention, regardless of the method used, has small warpage and excellent dimension accuracy as compared with those of the conventional damper. Moreover, the damper of the present invention has a low water absorption rate and high dimension stability, indicative of excellent water-proofness.

Figure 6:
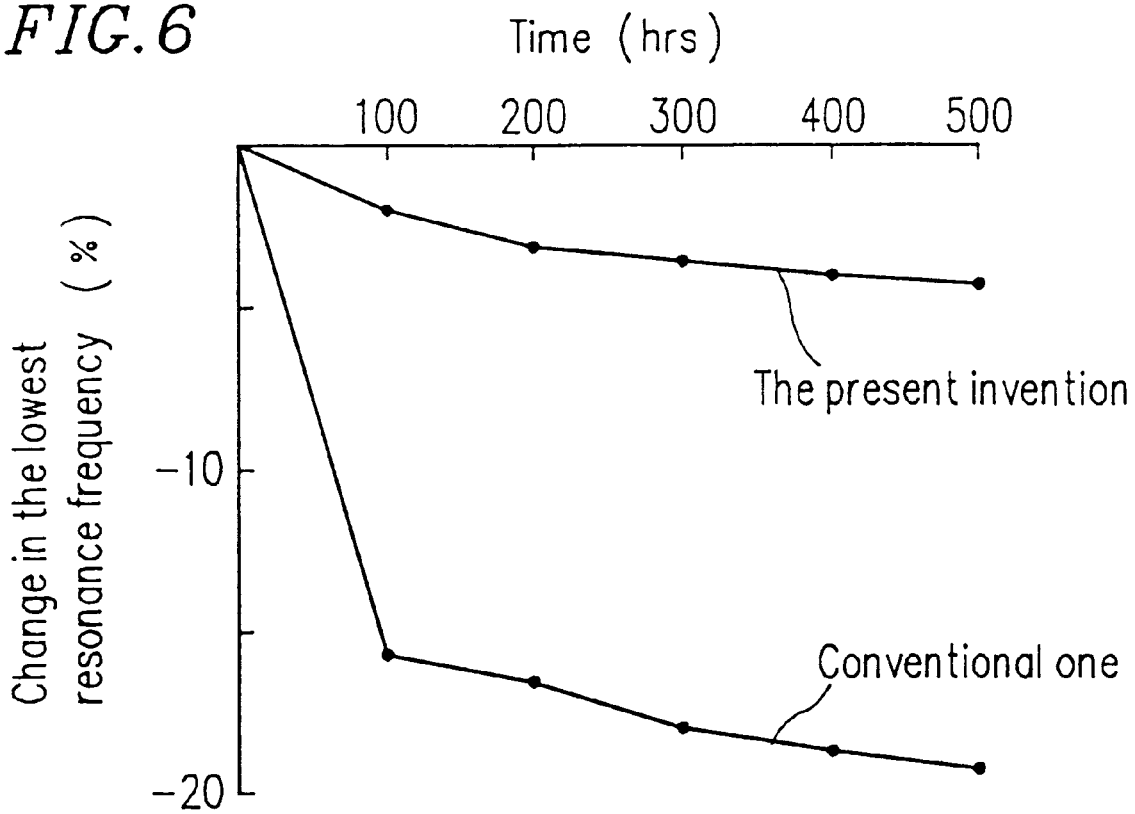
FIG. 6 is a graph showing changes over time in the lowest resonance frequencies of a loud speaker incorporating the damper of the present invention and a loud speaker incorporating a conventional damper.

FIG. 6 is a graph showing change over time in the lowest resonance frequency of a loud speaker (4 cm×3 cm) incorporating a damper produced by the third method when the loud speaker is continuously operated. For comparison, FIG. 6 also shows the characteristics of a loud speaker incorporating a conventional damper including a substrate composed of cotton yarns, which was also used in Table 1 above.

As seen from FIG. 6, the loud speaker incorporating the conventional damper has a drastic deterioration in its lowest resonance frequency in an early stage of use. On the other hand, the loud speaker incorporating the damper of the present invention has a very low change rate in the lowest resonance frequency thereof. Although it has conventionally been required to take into account a large deterioration in the lowest resonance frequency in the designing of a loud speaker, the damper of the present invention maintains satisfactory characteristics for a long time without even considering the change in the lowest resonance frequency. As a result, increased freedom is provided in the designing of a loud speaker incorporating the damper of the present invention.

The dampers produced by the first and the second methods have substantially the same characteristics as those shown in FIG. 6. Therefore, the above-mentioned effect can be similarly obtained by using the first or second pressing method.

In the above-mentioned example of the present invention, the core material of the core-sheath type filaments is polyester resin, while the sheath material of the filaments is modified polyester resin having a lower melting point than that of the core material. The reason for this is that polyester resin generally has low hygroscopicity and therefore contributes to the water-proofness of the molded damper. However, the present invention does not limit the core material and sheath material to the above.

Examples of thermoplastic resins which can be used as the core material were described above. Those which have relatively high melting points can be used. Not only crystalline polymer materials but also amorphous polymer materials can be used. Although the present specification chiefly employs the term "melting point" in order to describe one feature of the present invention, it is not intended that only crystalline materials having fixed melting points can be used for the present invention, but rather that the term "melting point" should be interpreted to include "softening point" of amorphous materials.

Thermosetting resins can be used as long as the softening points thereof are relatively low.

Although similar resins are used for the core material and the sheath material in the above example, this is not a limitation of the present invention. Any combination of resins can be used as long as the sheath resin has a lower melting point than that of the core material and has good comformability with the core material so as to provide sufficient bonding. For example, it is applicable to use polyester resin for the core material and polyamide resin having a lower melting point than the polyester resin for the sheath material.

The above-described molding conditions, such as the temperature and pressure during the molding process, are not limited to the above-mentioned values. These conditions can be optimized depending on the melting point (softening point) and the solidification point of the resin forming the sheath material.

Although a plain-weaved fabric is used as a substrate for the damper, the substrate is not limited thereto. Any weaving structure may be adopted as long as the resultant damper attains desired stiffness and softness. Knitted cloth having an appropriate structure may similarly be used instead of the fabric.

Moreover, no limitations are provided for the method for spinning core-sheath type filaments, the method for obtaining conjugated fibers by twisting together a plurality of filaments, or the method for obtaining a substrate of a woven fabric or knitted cloth from the conjugated fibers. For example, short fibers (threads) obtained by spinning conjugated fibers that have been processed into a cotton-like state may be used instead of long conjugated fibers.

As described above, the damper for a loud speaker according to the present invention is produced by molding a substrate composed of a fabric or knitted cloth incorporating core-sheath type conjugated fibers composed of filaments having a core-sheath type structure including a thermal fusion layer on the surface as a sheath material, the thermal fusion layer functioning as an excipient. As will be appreciated, the conventional process of producing a prepreg by impregnating the substrate with an excipient is not required in the production of the damper for a loud speaker according to the present invention.

Moreover, in the core-sheath type filaments constituting the substrate, the sheath material is fused by a heat treatment and then solidified during the molding process for the damper, so as to cover the surface of the filaments, thereby retaining the shape of the resultant damper. Since the core material itself is also deformed to some extent by the heat treatment during the molding, the substrate (of a fabric or knitted cloth) is not likely to have internal stress when the molded fabric is removed from a mold after conducting the pressing process. Neither is the core material deformed so as to diverge from a predetermined shape. As a result, the resultant damper has an extremely high dimension accuracy.

Furthermore, since the filaments constituting the substrate have a core-sheath structure, the core material to become a matrix for the substrate and the sheath material to serve as an excipient conform to each other so as to be bonded tightly together. Both the core material and the sheath material are flexible.

During the molding process, the sheath material functioning as an excipient is fused and then solidified so as to bond together the intersections of fibers of the fabric or knitted cloth constituting the substrate and to cover the entire surface of the fibers. As a result, even if the molded damper is subjected to a long-time use so as to be repeatedly deformed through flexure and bending, substantially no peeling occurs at interfaces between the core material and the sheath material, nor is the sheath material ripped. Therefore, the bonds at the intersections of the fibers constituting the fabric are prevented from being destroyed, and consequently the reduction in the stiffness of the entire damper is prevented. Thus, a loud speaker incorporating the damper of the present invention is not liable to excessive deterioration in its characteristics through use over a long time.

Resins used for the first component and the second component are selected so that a difference in softening temperatures thereof are 15° C. or more, preferably, 30° C. or more. Consequently, only the sheath material may be melted without melting the core material, and thus the aforementioned molding process is surely conducted.

Furthermore, the resins constituting the fibers of the substrate of a fabric or knitted cloth, from which the damper for a loud speaker of the present invention is produced, have a very low water absorption rate, so that the damper is not likely to be deformed due to stretching of the fibers absorbing moisture. Moreover, the sheath material, which is flexible enough not to be ripped due to deformation through flexure and bending, is fused and then solidified so as to cover the entire surface of the fibers during the molding process. As a result, moisture is prevented from entering interspaces between fibers and thereby causing the molded damper to be deformed so as to unfavorably affect the performance of the loud speaker.

No applications of a fabric or knitted cloth composed of conjugated fibers having a core-sheath structure to a use through which the fiber or knitted cloth may be deformed through flexure and bending over a long time, as in the case of the damper for a loud speaker, have been known. According to the present invention, a damper for a loud speaker which requires only a simple substrate production process and has excellent moldability, water-proofness, and durability is realized.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for producing a damper for a loud speaker, the damper being formed using as a substrate a fabric or knitted cloth composed of conjugate fibers, each of the conjugate fibers being formed using at least one filament having a core-sheath type structure, the core-sheath type structure including a core material formed of a first resin and a sheath material formed of a second resin functioning as a thermal fusion layer, the method comprising:

a heating step and a pressing step operatively combined for molding the substrate by applying a predetermined pressure operatively combined for a first predetermined period using a mold which is set at a first predetermined temperature such that the second resin is melted and then solidified; and a trimming step for trimming the molded substrate into a predetermined shape.

2. A method according to claim 1, wherein a difference in softening points of the first and second resins is 15° C. or more.

3. A method according to claim 1, wherein a difference in softening points of the first and second resins is 30° C. or more.

4. A method according to claim 1, wherein the first resin is polyester, and the second resin is polyester having a lower melting point than that of the first resin.

5. A method according to claim 1, wherein the first resin is polyester having a melting point of 220° C. or more, and the second resin is polyester having a melting point of 200° C. or less.

6. A method according to claim 1, wherein the pressing step further comprises:

a clamping step for clamping the substrate while applying a predetermined tension; and the heating step comprises a pre-heating step for placing the clamped substrate in an atmosphere at a second predetermined temperature which is in the vicinity or higher than the softening point of the second resin for a second predetermined period, wherein the first predetermined temperature in the pressing step is equal to or lower than a solidification point of the second resin.

7. A method according to claim 1, wherein the first predetermined temperature in the pressing step is a temperature in the vicinity of or higher than the softening point of the second resin.

8. A method according to claim 1, wherein the heating step and the pressing step operatively combined further comprise a cooling step for cooling the molded substrate to a predetermined temperature which is equal to or lower than a solidification point of the second resin while being maintained in the mold, and the first predetermined temperature in the pressing step is a temperature in the vicinity of or higher than the softening point of the second resin.

9. A method for producing a loud speaker comprising a damper, the damper being formed using as a substrate a fabric or knitted cloth composed of conjugate fibers, each of the conjugate fibers being formed using at least one filament having a core-sheath type structure, the core-sheath type structure including a core material formed of a first resin and a sheath material formed of a second resin functioning as a thermal fusion layer, the method comprising:

a heating step and a pressing step operatively combined for molding the substrate by applying a predetermined pressure for a first predetermined period using a mold which is set at a first predetermined temperature such that the second resin is melted and then solidified; and a trimming step for trimming the molded substrate into a predetermined shape.

10. A method according to claim 9, wherein the pressing step further comprises:

a clamping step for clamping the substrate while applying a predetermined tension; and the heating step comprises a pre-heating step for placing the clamped substrate in an atmosphere at a second predetermined temperature which is in the vicinity or higher than the softening point of the second resin for a second predetermined period, wherein the first predetermined temperature in the pressing step is equal to or lower than a solidification point of the second resin.

11. A method according to claim 9, wherein the first predetermined temperature in the pressing step is a temperature in the vicinity of or higher than the softening point of the second resin.

12. A method according to claim 9, wherein the heating step and the pressing step operatively combined further comprise a cooling step for cooling the molded substrate to a predetermined temperature which is equal to or lower than a solidification point of the second resin while being maintained in the mold, and the first predetermined temperature in the pressing step is a temperature in the vicinity of or higher than the softening point of the second resin.

* * * * *